US007500884B2

(12) United States Patent
Peters et al.

(10) Patent No.: US 7,500,884 B2
(45) **Date of Patent: *Mar. 10, 2009**

(54) COAXIAL SYSTEM WITH KEYING FEATURE

(75) Inventors: Jeffrey Louis Peters, Eagan, MN (US); David J. Johnsen, Plymouth, MN (US); Kenneth Allen Skluzacek, Belle Plaine, MN (US); Duane R. Sand, Annandale, MN (US); M'hamed Anis Khemakhem, Eden Prairie, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/069,038

(22) Filed: Feb. 6, 2008

(65) Prior Publication Data

US 2008/0139051 A1 Jun. 12, 2008

Related U.S. Application Data

(63) Continuation of application No. 11/645,105, filed on Dec. 20, 2006, now Pat. No. 7,329,155, which is a continuation of application No. 11/408,588, filed on Apr. 21, 2006, now Pat. No. 7,163,423.

(51) Int. Cl.
*H01R 13/64* (2006.01)

(52) U.S. Cl. ..... 439/680; 439/677; 439/540.1; 439/188

(58) Field of Classification Search ..... 439/680, 439/677, 540.1, 188, 674, 668, 669
See application file for complete search history.

(56) References Cited

U.S. PATENT DOCUMENTS

| | | | | |
|---|---|---|---|---|
| 3,351,892 | A | 11/1967 | Feeser | |
| 5,266,042 | A | 11/1993 | Hampel | |
| 5,885,096 | A | 3/1999 | Ogren | |
| 5,938,478 | A | 8/1999 | Werner | |
| 6,045,378 | A | 4/2000 | Follingstad | |
| 6,835,093 | B1 | 12/2004 | Griffin et al. | |
| 6,848,948 | B1 | 2/2005 | Khemakhem et al. | |
| 7,163,423 | B1 | 1/2007 | Peters et al. | |
| 7,329,155 | B2 * | 2/2008 | Peters et al. | 439/680 |
| 2005/0221673 | A1 | 10/2005 | Myer et al. | |

FOREIGN PATENT DOCUMENTS

EP 1 453 151 A2 9/2004

OTHER PUBLICATIONS

ADC Telecommunications, Inc. "Video Products—CAPS Component Patching System," p. 20 of Catalog (1 page), May 2000.

* cited by examiner

*Primary Examiner*—Tho D Ta
(74) *Attorney, Agent, or Firm*—Merchant & Gould P.C.

(57) ABSTRACT

A keying system to control a mating interface between a plurality of mating jacks and plugs in a coaxial telecommunications panel.

11 Claims, 6 Drawing Sheets

COAXIAL SYSTEM WITH KEYING FEATURE

CROSS REFERENCE TO RELATED APPLICATIONS

This application is a continuation of application Ser. No. 11/645,105, filed Dec. 20, 2006 now U.S. Pat. No. 7,329,155, which is a continuation of application Ser. No. 11/408,588, filed Apr. 21, 2006, now U.S. Pat. No. 7,163,423, which applications are incorporated herein by reference.

FIELD

This invention pertains to the telecommunications industry. More particularly, this invention pertains to coaxial jacks and plugs with a keying feature to correctly route the signals.

BACKGROUND

Coaxial jacks and plugs are used to route and manage coaxial signals. Multiple jacks can be organized in panels. The panels are typically labeled to distinguish the jacks from one another. However, when the jacks and the plugs can be used interchangeably, there is a possibility that a plug will be inserted into an incorrect jack.

High definition video broadcast standard uses dual coaxial lines to carry the complete signal. For example, one coaxial line carries an "A" signal while the other coaxial line carries a different "B" signal. While routing the high definition signal with a dual port plug, it is important to insert the dual port plug in the correct orientation into a telecommunications equipment such as a coaxial jack panel so that the dual coaxial high definition lines are correctly matched up and routed through the system. A keying feature is desirable to correctly orient the dual port plug to correctly route the dual high definition video signals.

SUMMARY

The present invention relates to a coaxial system with a keying feature to allow correct mating of coaxial jacks and plugs to correctly route signals. In one embodiment, a panel includes a plurality of jacks, where the jacks include a mating interface feature that only allows certain plugs to be mated. The plugs are paired to form a dual plug where the dual plug can only be mated with the jacks when the dual plug is in the proper orientation with respect to the mating jacks.

BRIEF DESCRIPTION OF THE DRAWINGS

The accompanying drawings, which are incorporated in and constitute a part of the specification, illustrate several aspects of the present invention and together with the description, serve to explain the principles of the invention. A brief description of the drawings is as follows.

DETAILED DESCRIPTION

Reference will now be made in detail to the exemplary aspects of the present invention that are illustrated in the accompanying drawings. Wherever possible, the same reference numbers will be used throughout the drawings to refer to the same or like parts.

Figure 1:
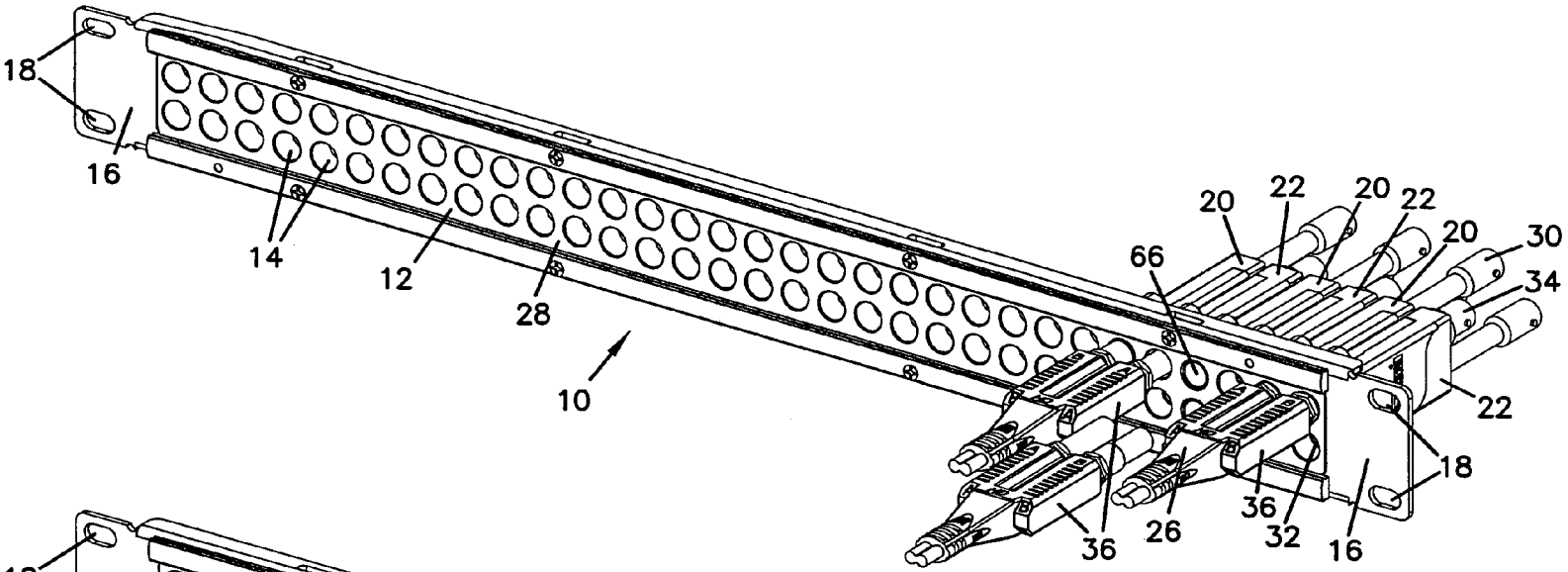
FIG. 1 is a front perspective view of a telecommunications panel according to the present invention, the panel illustrated with a plurality of coaxial jacks mounted to a rear of a frame of the panel and a plurality of dual port plugs mounted to a front of the frame of the panel, one of the dual port plugs shown inserted into the frame in the correct orientation, one of the dual port plugs shown inserted into the frame in the incorrect orientation, and one of the plugs shown prior to insertion.
Figure 2:
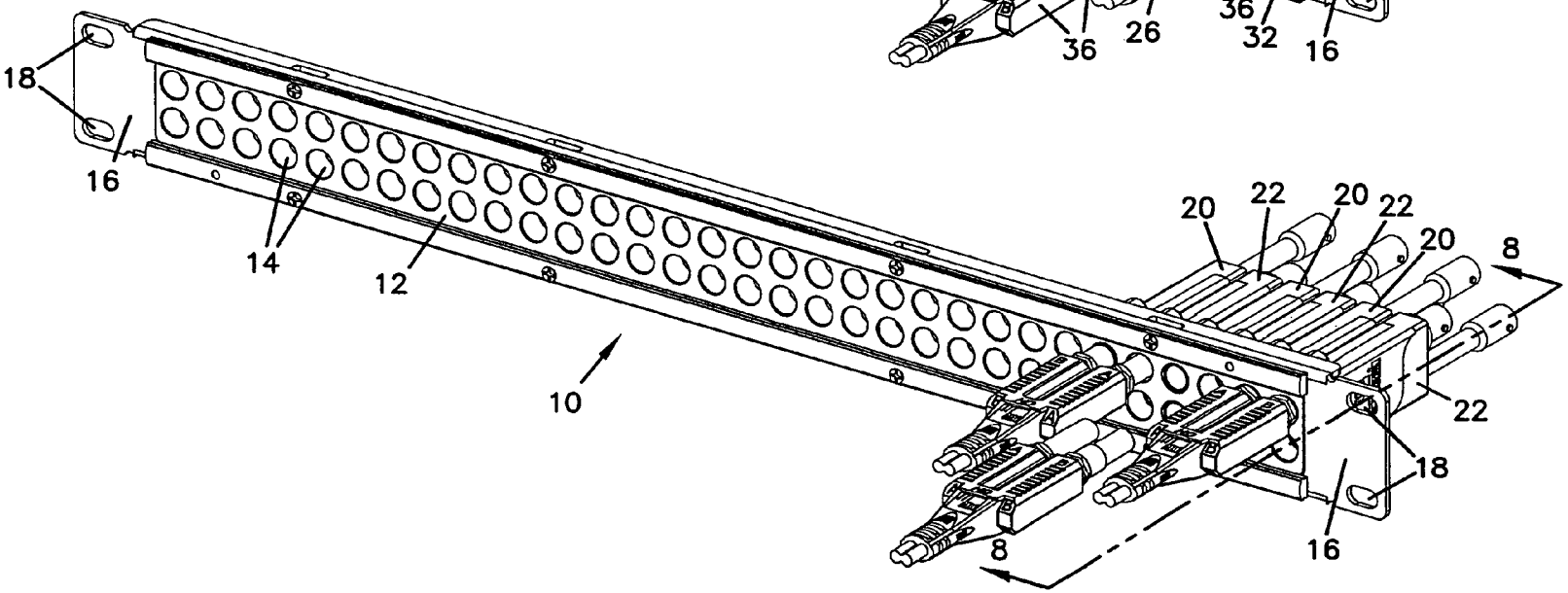
FIG. 2 is a front perspective view of the telecommunications panel of FIG. 1, illustrating the uncoupled dual port plug of FIG. 1 correctly inserted into the frame of the panel.

FIGS. 1-2 illustrate a front perspective view of a panel 10 according to the invention. Panels 10 such as shown in FIGS. 1-2 might be installed in broadcast communications production facilities. Panel 10 includes a frame 12 with a plurality of openings 14. Frame 12 includes a pair of opposing mounting flanges 16 on sides of frame 12 to facilitate mounting panel 10 to a communications equipment rack or other mounting structure in broadcast facility. Flanges 16 include openings 18 for receiving fasteners to secure panel 10 to the rack or other mounting structure.

Panel 10 is shown in FIGS. 1-2 with first coaxial jacks 20 and second coaxial jacks 22 mounted to a rear side 24 of frame 12. First coaxial jacks 20 include a set of front connectors or ports 26, accessible through openings 14 from a front side 28 of frame 12 and a set of rear connectors or ports 30, accessible from a rear side 24 of frame 12. Second coaxial jacks 22 also include a set of front connectors or ports 32, accessible through openings 14 from front side 28 of frame 12 and a set of rear connectors or ports 34, accessible from rear side 24 of frame 12. First coaxial jacks 20 and second coaxial jacks 22 are mounted to frame 12 in an alternating fashion. First coaxial jacks 20 are used for routing a first signal, for example, a signal "A", and second coaxial jacks 22 are used for routing a different second signal, for example, a signal "B".

First and second coaxial jacks 20, 22 may include normal through switching type jacks. In other embodiments, first and second coaxial 20, 22 jacks may include straight through (non-switching) jacks or other types of jacks. Switching type jacks provide internal circuitry so that without a plug inserted within either of the front connectors, an electrical path is defined between the pair of rear connectors. No such circuitry is provided in straight through jacks. U.S. Pat. No. 5,885,096, the disclosure of which is incorporated herein by reference, discloses a switching jack similar to first and second coaxial switching jacks 20, 22 depicted in FIGS. 1-2 and 7-12 of the present disclosure.

Figure 3:
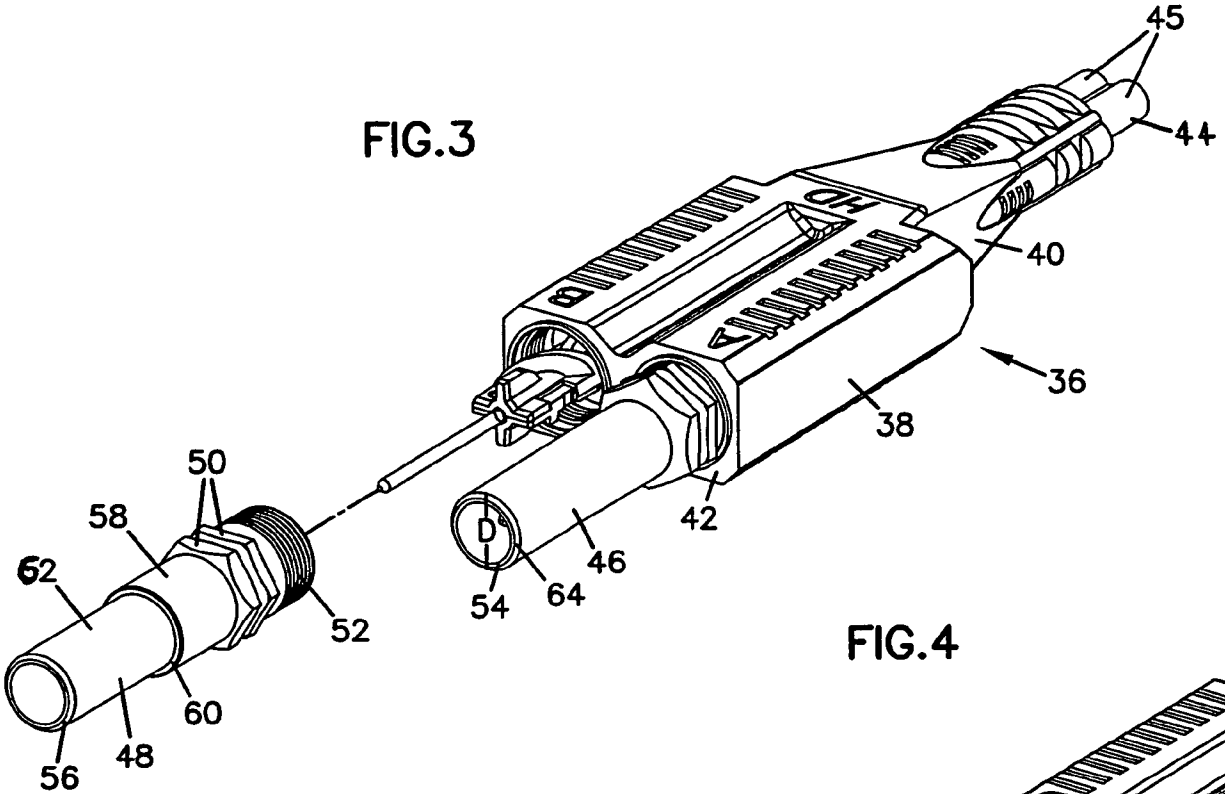
FIG. 3 is a partially exploded perspective view of a dual port plug according to the invention.
Figure 4:
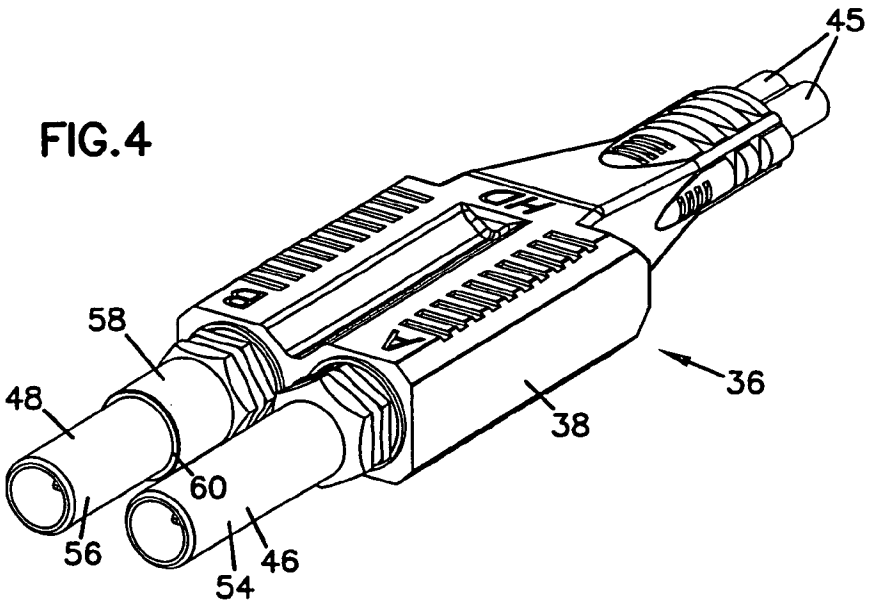
FIG. 4 is a perspective view of the dual port plug of FIG. 3, illustrated in an assembled configuration.
Figure 5:
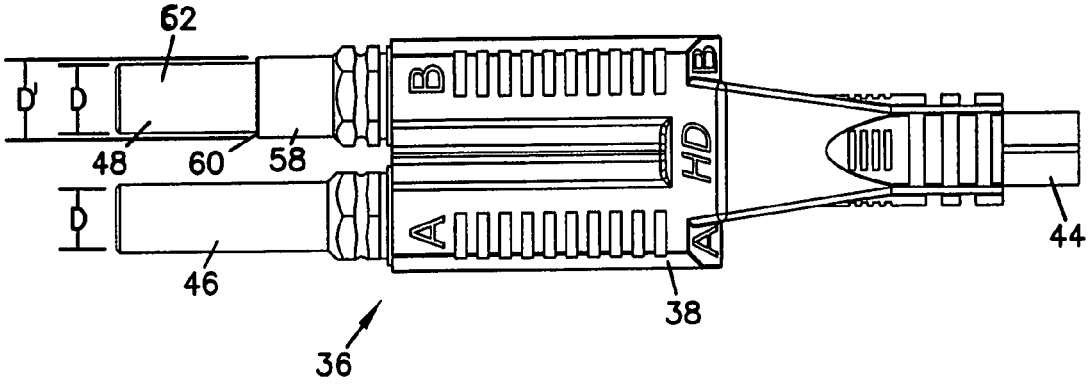
FIG. 5 is a top plan view of the dual port plug of FIG. 3.
Figure 6:
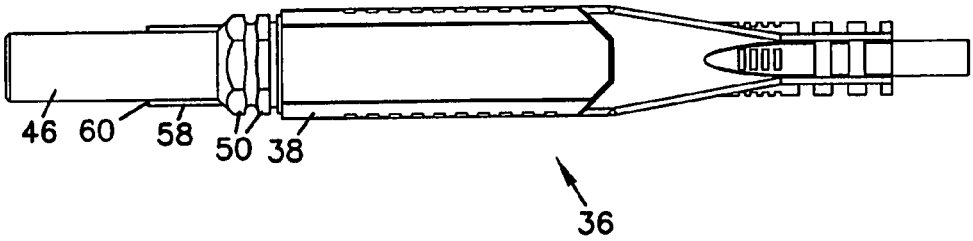
FIG. 6 is a side elevational view of the dual port plug of FIG. 3.

Still referring to FIGS. 1-2, panel 10 is also shown with dual port plugs 36 coupled to first and second coaxial jacks 20, 22 through frame 12. Dual port plugs 36 are illustrated in FIGS. 3-6. Each dual port plug 36 is configured to carry two broadcast signals and patch these signals simultaneously. For example, as depicted in FIG. 3, each dual port plug 36 carries an "A" signal and a different "B" signal. When coupling dual port plugs 36 with coaxial jacks 20, 22, as shown in FIGS. 1-2, it becomes important to orient plugs 36 correctly with respect to coaxial jacks 20, 22 such that the port carrying the "A" signal is inserted into front connectors 26 of first coaxial jacks 20 routing the "A" signal and the port carrying the "B" signal is inserted into front connectors 32 of second coaxial jacks 22 routing the "B" signal. As will be discussed in further detail below, dual port plug 36 and first and second coaxial jacks 20, 22 cooperatively form a keying arrangement to ensure that the correct ports are inserted into the correct front connectors.

Referring to FIGS. 3-6, each dual port plug 36 includes a plug body 38 with a first end 40 and a second end 42. Extending from first end 40 is a dual signal cable 44. Cable 44 includes two wires 45. Extending from second end 42 are a first plug barrel 46 and a second plug barrel 48. Plug barrels 46, 48 are threadingly coupled to plug body 38. Flats 50 are defined adjacent threads 52 to facilitate fastening and removing of barrels 46, 48 from plug body 38. Opposite the end with threads 52 are connection ends 54 and 56 of first plug barrel 46 and second plug barrel 48, respectively. Connection ends 54, 56 of first and second plug barrels 46, 48 are configured to be inserted within openings 14 defined on frame 12 to mate with front coaxial jack connectors 26, 32. Plug body 38 includes an inner conductive body portion, and an outer non-conductive body portion.

Connection end 54 of the first plug barrel 46 includes a generally cylindrical shape with a uniform diameter D. Connection end 56 of second plug barrel 48 also includes a generally cylindrical shape. However, connection end 56 of second plug barrel 48 includes a larger diameter portion 58 with a diameter D' that defines a shoulder 60 with a smaller diameter portion 62 that includes a diameter D similar in size to diameter D of connection end 54 of first plug barrel 46 (see FIGS. 5 and 6). Shoulder 60 forms a keying feature to provide for correct orientation of plug 36 for insertion into coaxial jacks 20, 22 of panel 10.

Figure 7:
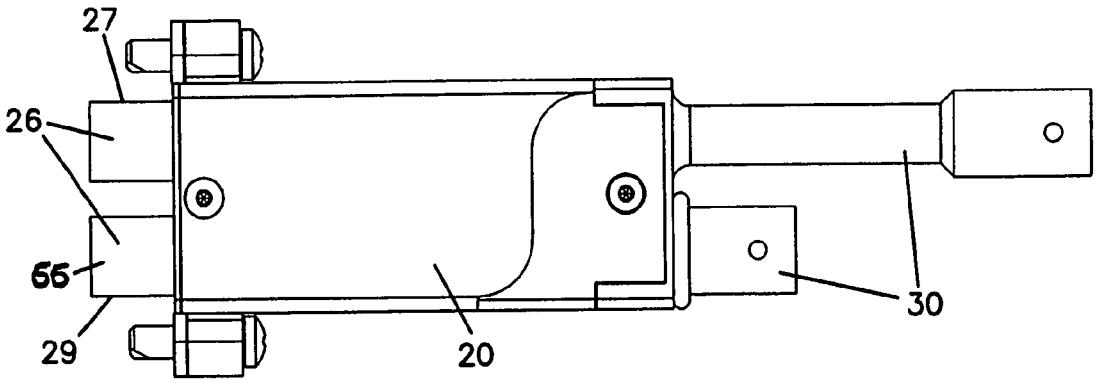
FIG. 7 is a side elevational view of a coaxial switching jack for routing a first type of signal according to the invention.
Figure 8:
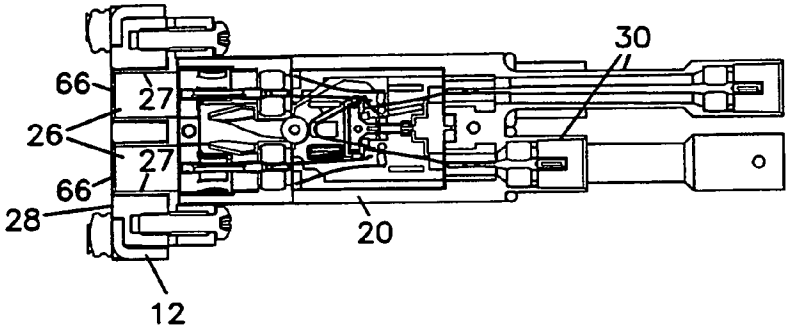
FIG. 8 is a cross-sectional view of the coaxial switching jack of FIG. 7 coupled to the frame of FIG. 1, the cross-sectional view taken along a line similar to line 8-8 of FIG. 2.

FIG. 7 illustrates a side view of one of first coaxial jacks 20 used for routing signal "A". FIG. 8 illustrates a cross-sectional view of a first coaxial jack 20 inserted into frame 12. As shown in FIG. 8, the barrels 27 of front connectors 26 lie flush with front side 28 of frame 12.

Figure 10:
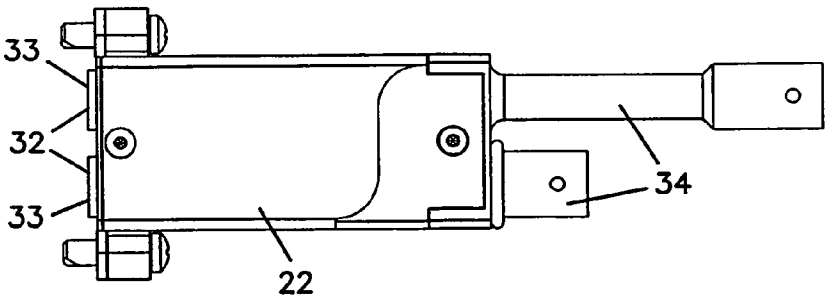
FIG. 10 is a side elevational view of a coaxial switching jack for routing a second type of signal according to the invention.
Figure 11:
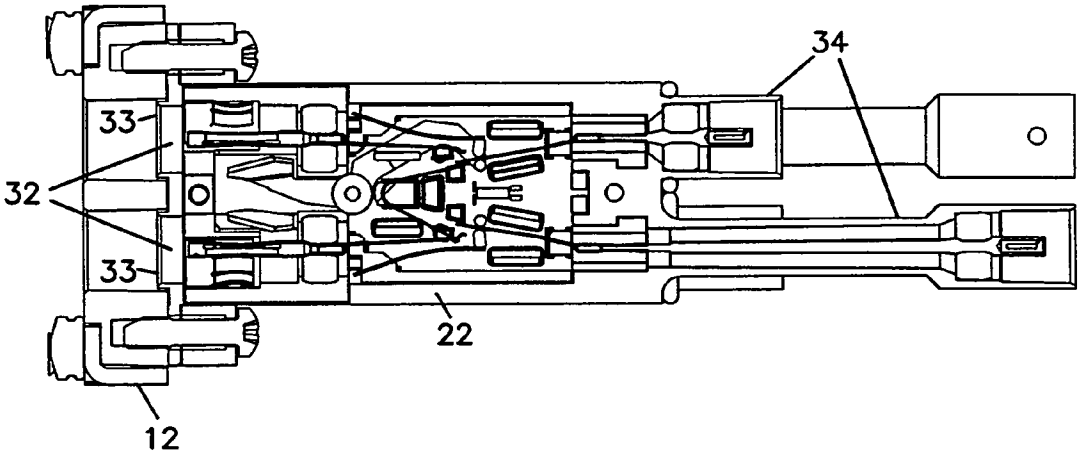
FIG. 11 is a cross-sectional view of the coaxial switching jack of FIG. 10 coupled to the frame of FIG. 1, the cross-sectional view taken along a line similar to line 8-8 of FIG. 2.

FIG. 10 illustrates a side view of one of second coaxial jacks 22 used for routing signal "B". Front connectors 32 of second coaxial jacks 22 have a length L that is shorter than front connectors 26 of first coaxial jacks 20. FIG. 11 illustrates a cross-sectional view of a second coaxial jack 22 inserted into frame 12. As shown in FIG. 11, the barrels 33 front connectors 32 of second coaxial jack 22 are set back from front side 28 of frame 12.

Figure 9:
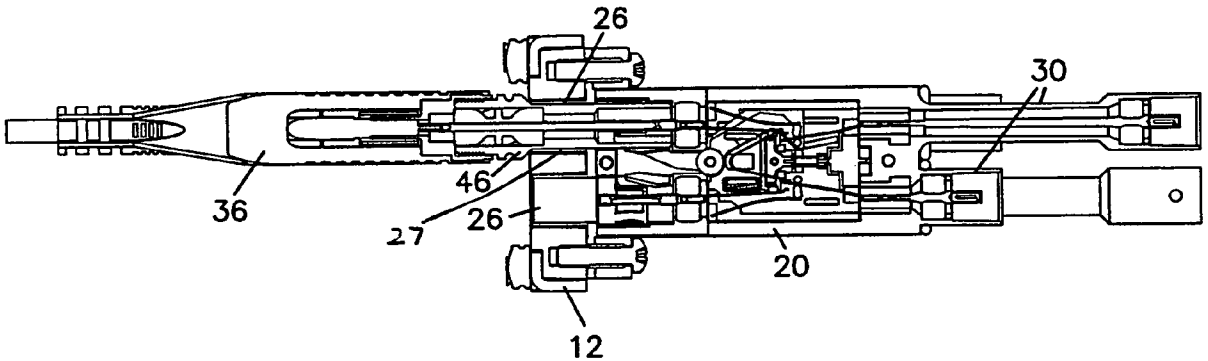
FIG. 9 is a cross-sectional view of the coaxial switching jack of FIG. 7 and the dual port plug of FIG. 3 coupled to the frame of FIG. 1, the cross-sectional view taken along a line similar to the line 8-8 of FIG. 2.
Figure 12:
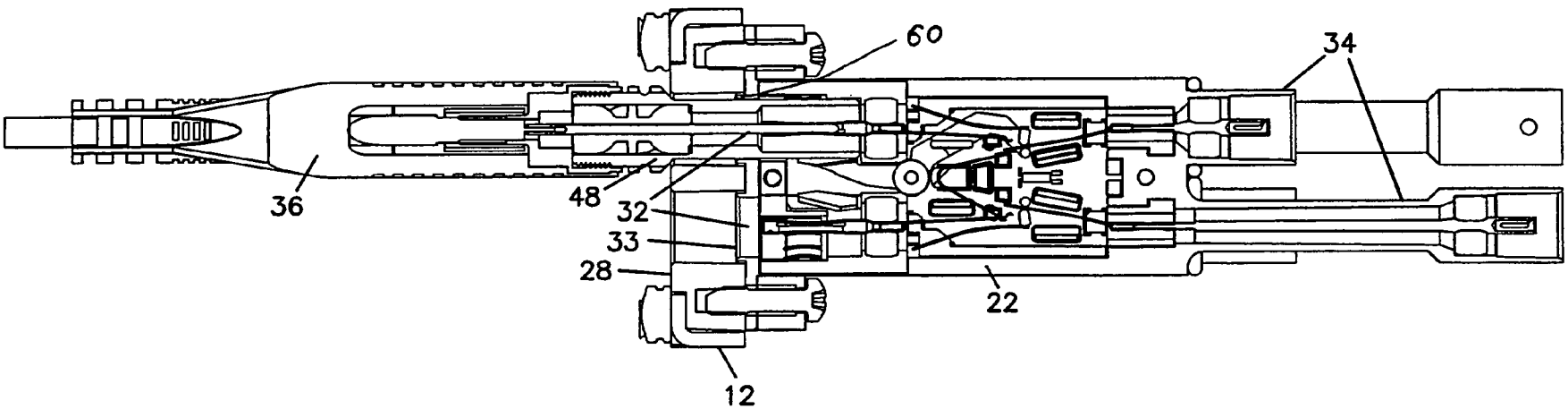
FIG. 12 is a cross-sectional view of the coaxial switching jack of FIG. 10 and the dual port plug of FIG. 3 coupled to the frame of FIG. 1, the cross-sectional view taken along a line similar to the line 8-8 of FIG. 2.

Referring now to FIGS. 9 and 12, the keying feature of dual plug 36 and coaxial jacks 20, 22 is illustrated. As shown in FIG. 9, first plug barrels 46 are fully insertable into front connectors 26 of first coaxial jacks 20 since diameter D of first plug barrels 20 are small enough to fit within front connectors 26. As shown in FIG. 12, second plug barrels 48 are fully insertable into front connectors 32 of second coaxial jacks 22 since front connectors 32 of second coaxial jacks 22 are set back to accommodate larger diameter portions 58 defining shoulders 60.

Figure 13:
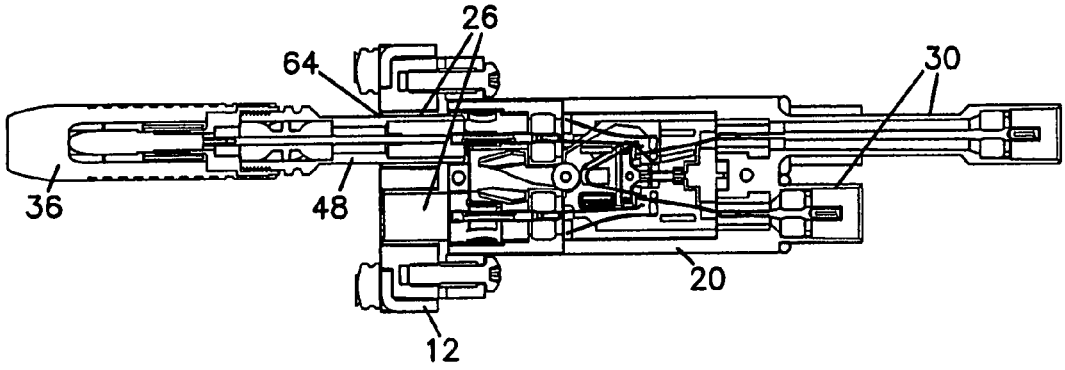
FIG. 13 is a cross-sectional view of the coaxial switching jack of FIG. 7 and the dual port plug of FIG. 3 incorrectly coupled, the cross-sectional view taken along a line similar to the line 8-8 of FIG. 2.

On the other hand, if plug 36 was flipped 180 degrees and second plug barrels 48 were to be inserted into front connectors 26 of first coaxial jacks 20, second plug barrels 48 would only be able to extend part way into front connectors 26 since shoulder 60 would abut against front connector walls 64 lying flush with front side 28 of frame 12 (see FIG. 13). Shoulder 60 includes about the same size diameter as opening 66 defined by front connectors 26 of first coaxial jacks 20 and thus is able to prevent insertion of second plug barrels 48 past a certain predetermined point into front connectors 26 of first coaxial jacks 20.

In this manner, as shown in FIG. 1, when dual plug 36 is oriented and inserted incorrectly, connection ends 54, 56 of the first and second plug barrels 46, 48 cannot be fully inserted into front connectors 32, 26 of second and first coaxial jacks 22, 20, respectively, and end up protruding out partially from frame 12. As shown in FIG. 1, when dual plug 36 is oriented correctly, plug barrels 46, 48 are fully insertable into front connectors 26, 32 of coaxial jacks 20, 22.

Shoulder 60 defined by larger diameter portion 58 of second plug barrel 48 is located such that second plug barrel 48 cannot be inserted into front connector 26 of first coaxial jack 20 past a predetermined point or a predetermined distance, as neither can first plug barrel 46. For example, in one embodiment, wherein first coaxial jack 20 is a switching type jack, the predetermined distance is such that insertion of second plug barrel 48 incorrectly will not actuate levers 68 to break the normal through routing. In other embodiments, for example, wherein first coaxial jack 20 might be a straight through jack, the predetermined distance could be such that insertion of second plug barrel 48 incorrectly will still prevent either of plug barrels 46, 48 from extending far enough into the front connectors to cross the signals, causing a disruption of service.

Thus, in the preferred embodiment, the combination of first and second plug barrels 46, 48 and first and second coaxial jacks 20, 22 and frame 12 serves a dual purpose. First, the features prevent incorrect orientation of dual plug 36 with respect to coaxial jacks 20, 22 of panel 10. Second, even if dual plug 36 is oriented and inserted incorrectly into front connectors 26, 32, of coaxial jacks 20, 22, the features prevent breaking normal-through routing in the case of switching jacks or prevents disruption of service in the case of straight through jacks.

It should be noted that the high definition video broadcast industry is only one of many different industries utilizing simultaneous dual signal patching. The keying feature formed from the combination of first and second plug barrels 46, 48 and first and second coaxial jacks 20, 22 and frame 12 is not limited to high definition video broadcasting and can be used in other applications using dual signal patching and other signal patching where there is a desire to prevent certain plugs and jacks from being mated.

Figure 14:
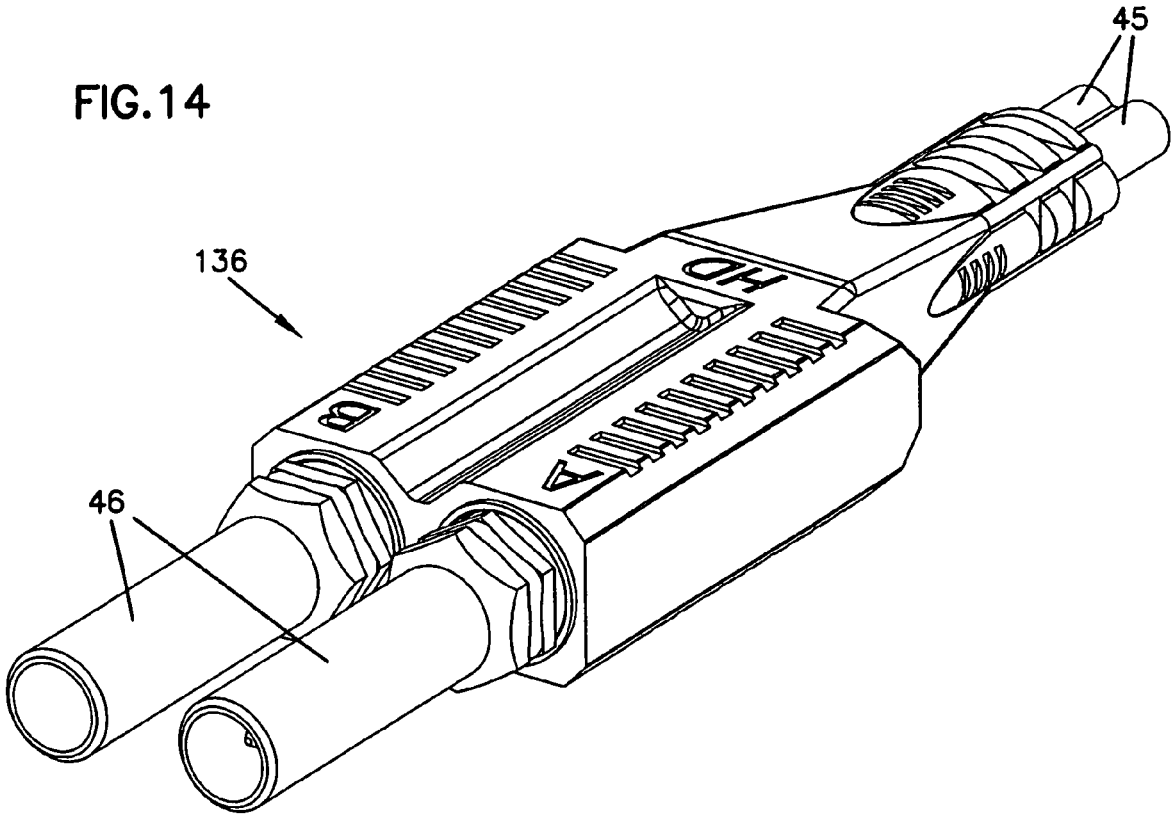
FIG. 14 is a perspective view of a dual port plug with identical plug barrels.

If desired, plug 36 can be constructed with identical plug barrels 46 as shown in FIG. 14 for plug 136. Plug 136 can be used with a jack panel like panel 10. However, plug 136 will be insertable in either orientation. Plug 136 is not a keyed component. Plug 136 can be changed to a keyed plug 36 by changing the "B" barrel 46 to a "B" barrel 48. Plugs 36, 136 can include indicia molded into plug body 38 for the "A" and "B" signal lines.

The above specification, examples and data provide a complete description of the manufacture and use of the invention. Since many embodiments of the invention can be made without departing from the spirit and scope of the invention, the invention resides in the claims hereinafter appended.

What is claimed is:

1. A coaxial telecommunications assembly comprising:

a first coaxial jack including a front connector defining a first exterior shape;

a second coaxial jack including a front connector defining a second exterior shape that is different than the first exterior shape; and a plug including a first mating coaxial connector and a second mating coaxial connector, the plug configured for insertion into both the first coaxial jack and the second coaxial jack to simultaneously route a first signal through the first coaxial jack and route a second signal through the second coaxial jack, wherein the second mating coaxial connector defines a different shaped interface than the first mating coaxial connector such that the second mating coaxial connector is only fully insertable into the front connector of the second coaxial jack and is not fully insertable into the front connector of the first coaxial jack to correctly align the plug with respect to the first and second coaxial jacks to correctly route the first and second signals, wherein the plug and the first and second coaxial jacks are configured such that if the second mating coaxial connector is incorrectly inserted into the front connector of the first coaxial jack, the second mating coaxial connector does not extend far enough into the front connector of the first coaxial jack to establish an electrical connection.

2. A coaxial telecommunications assembly according to claim 1, wherein the front connector of the second coaxial jack defines a shorter length than the front connector of the first coaxial jack.

3. A coaxial telecommunications assembly according to claim 1, wherein the first and second coaxial jacks are switching type jacks and wherein if the second mating coaxial connector is incorrectly inserted into the front connector of the first coaxial jack, a switch mechanism of the first coaxial jack is not triggered.

4. A coaxial telecommunications assembly according to claim 1, wherein the first and second coaxial jacks are straight-through jacks and wherein if the second mating coaxial connector is incorrectly inserted into the front connector of the first coaxial jack, the second mating coaxial connector does not extend far enough into the front connector of the first coaxial jack to cross the first and second signals, causing a disruption of service.

5. A coaxial telecommunications assembly according to claim 1, wherein the second mating coaxial connector defines a portion with a larger diameter than the first mating coaxial connector.

6. A telecommunications plug comprising:

a body with a first end and a second end, extending from the first end is a dual signal cable and extending from the second end is a removable first barrel carrying a first telecommunications signal and a removable second barrel carrying a second telecommunications signal, the first and the second barrels threadingly coupled to the body of the telecommunications plug; and the removable first barrel including a first outer shape and the removable second barrel including a second outer shape that is different than the first outer shape such that the first barrel and the second barrel define a keyed plug;

wherein either of the first barrel and the second barrel is removable and replaceable with a barrel having the same outer shape as the remaining barrel to convert the plug from a keyed plug to a non-keyed plug.

7. A telecommunications plug according to claim 6, wherein the first barrel includes a generally cylindrical shape with a uniform diameter extending from a connection end of the first barrel to the body and the second barrel includes a generally cylindrical shape with a first diameter portion extending from a connection end of the second barrel to a second larger diameter portion, the larger diameter portion defining a shoulder with the first diameter portion, the first diameter portion having a diameter similar in size to the diameter of the first barrel.

8. A telecommunications plug according to claim 6, wherein the first and second barrels are each threadably mounted to a conductive body portion wherein a non-conductive housing surrounds the conductive body portion.

9. A telecommunications plug according to claim 6, wherein the body includes indicia for each of the first and second barrels to differentiate the telecommunications signals carried by the first and second barrels.

10. A telecommunications plug according to claim 9, wherein the indicia includes the letters "A" and "B".

11. A telecommunications plug according to claim 6, wherein each of the first and the second barrels includes flats to facilitate fastening and removing of the barrels from the plug body.

* * * * *